US005855525A

United States Patent [19]

Turner

[11] Patent Number: 5,855,525

[45] **Date of Patent: *Jan. 5, 1999**

[54] GOLF CLUB

[76] Inventor: Terry S. Turner, 1280 Tacoma Way, Reno, Nev. 85909

[ * ] Notice: The term of this patent shall not extend beyond the expiration date of Pat. No. 5,322,285.

[21] Appl. No.: 636,891

[22] Filed: Apr. 24, 1996

Related U.S. Application Data

[63] Continuation of Ser. No. 184,385, Jan. 19, 1994, which is a continuation-in-part of Ser. No. 980,458, Nov. 23, 1992, Pat. No. 5,322,285.

[51] Int. Cl.[6] ..... A63B 53/12; A63B 53/14; A63B 53/00

[52] U.S. Cl. ..... 473/300; 473/316; 473/324

[58] Field of Search ..... 473/300, 201, 473/202, 203, 302, 316, 313, 314, 317, 318, 319, 320, 321, 251, 252, 324, 340, 349

[56] References Cited

U.S. PATENT DOCUMENTS

| | | | |
|---|---|---|---|
| 1,680,447 | 8/1928 | Bryant | 273/80 R |
| 2,099,319 | 11/1937 | Shaw . | |
| 3,318,602 | 5/1967 | Kunihisa . | |
| 3,530,048 | 9/1970 | Darrow | 273/80 R |
| 4,125,260 | 11/1978 | Kanne | 273/80 R |
| 4,979,743 | 12/1990 | Sears . | |
| 5,322,285 | 6/1994 | Turner | 273/164.1 |

FOREIGN PATENT DOCUMENTS

| | | | |
|---|---|---|---|
| 2251801 | 7/1992 | United Kingdom | 273/81 R |

OTHER PUBLICATIONS

Gene et al, "Mechanics of Materials", 1984 by Wadsworth, Inc., pp. 744–746.

*Primary Examiner*—Sebastiano Passaniti
*Attorney, Agent, or Firm*—L. Lee Humphries

[57] ABSTRACT

A golf club has a high modulus of elasticity grip which is, preferably, an all-metal grip. The grip is connected to the shaft and the shaft is connected to the head without intervening material, such as by welding, brazing, force fit, pinning or similar method, or by intervening material having a modulus of elasticity 100,000 psi or greater. The golf club, or its parts, may be cast, forged, bonded, or otherwise manufactured and assembled. In the preferred embodiment, which is a putter, the grip and shaft both have high modulus of elasticity. In the putter, there is achieved a very stiff, but sensitive, low frequency "feel". Such metal or high modulus of elasticity grip is also used in irons, woods and playing utility clubs and provides an improved "feel" and sound.

12 Claims, 10 Drawing Sheets

GOLF CLUB

This application is a continuation of 08/184,385, filed Jan. 19, 1994 which is a continuation-in-part of application Ser. No. 07/980,458, filed Nov. 23, 1992, entitled Golf Putter, now U.S. Pat. No. 5,322,285, by the same inventor as herein.

This invention is a golf club having a grip whose body is of high modulus of elasticity and which grip, in the preferred embodiment, is constructed throughout of one or more metals, alloys, metal compounds or metal mixtures. Such concept is advantageously used in putters, irons, woods and playing utility clubs, whether such golf clubs are made of wood, metal, plastic or other materials. The term "woods" herein includes, without limitation, drivers, metal woods, ceramic woods, graphite composite woods, persimmon woods and various other clubs, all of which are commonly called "woods". The term "playing utility clubs" herein includes irons, wedges, and chippers.

The construction of a golf club, as taught herein, provides increased "feel" and sound which provide extraordinary control to the user. In the putter, the grip, shaft and head may all advantageously be constructed of high modulus of elasticity material or materials. However, in the irons, woods and playing utility clubs, the shaft may not have such high modulus of elasticity. That is, the irons, woods and utility clubs are less stiff and more "whippy". Nevertheless, in the putters, irons, woods and playing utility clubs, having a high modulus of elasticity in the body of the grip is particularly advantageous. Even though the shafts in the woods and playing utility clubs do not have as high a modulus of elasticity as in the putter, still, the high modulus of elasticity grip is connected to the shaft with either no intervening material or an epoxy, adhesive or other material which is modified to have a modulus of elasticity which is substantially higher than in the case of the epoxy or adhesives which are presently in common use. An intervening material, of epoxy or adhesive with a metal filler, having a modulus of elasticity of approximately 100,000 psi or greater, is suitable as an intervening material, between shaft and grip, in the device of the invention, particularly in the wood and playing utility club.

Additionally, connecting the shaft of the putter, iron, wood and playing utility club to the head without any intervening material, or with a material also having a modulus of elasticity of approximately 100,000 psi or greater, enhances the "feel" and sound to the golfer. The full advantage of the invention is best obtained by using no intervening material between grip, shaft and head, and connecting grip to shaft and shaft to head by welding, brazing, bonding, soldering, fusing, swaging, interference fitting, sweating, pinning or keying or similar method. Intervening material between grip and shaft, in the shape of a collar around the shaft, as described hereafter, may be used, but it, too, will be directly connected to grip and shaft by welding, brazing, bonding, soldering, fusing, swaging, interference fitting, sweating, pinning or keying or similar method.

Connection of shaft to grip and shaft to head, without any intervening material, such as by welding, brazing, pinning, brazing, and similar methods mentioned previously, is the first preferred embodiment. The second preferred embodiment is one which uses an intervening material having a modulus of elasticity no less than the modulus of elasticity of whichever is least, the shaft or the grip. Third in the order of preference is the embodiment in which and intervening material is used, but it has a modulus of elasticity greater than 100,000 psi. All of such embodiments provide superior sound and "feel" over golf clubs in common use.

It is noted that "Gold Magazine's Encyclopedia of Golf," edited by Robert Scharff and the Editors of Gold magazine, states on page 221, that an iron's typical total weight is 12½ ounces to 15⅜ ounces. A putter, from page 288, is said to weight from 15 to 18 ounces with the head accounting for not quite two-thirds of the over-all weight. A putter of heavier weight than those stated above will "cut down on your touch", according to said Encyclopedia, page 228. According to the same reference, page 228, most professionals use putter weights of 16 to 17 ounces. The Dynacraft 1992 catalog, page 132, shows putter shafts of 35" length weighing 4.1 ounces and of 54" length, (extra long), weighing 6.4 ounces. A table on page 96 of that catalog shows putter heads from 288 grams, 10 ounces, to 400 grams, 14 ounces. Commonly, the weight of grips, in prior art, is so small it is insignificant. The shaft of a wood is approximately 3 to 5 ounces. The typical wood, including the drivers, is of a weight approximately the same, or a little less, than the iron or the putter. The typical total weight of a driver of wood head is 198 grams, which is 7 ounces, to 235 grams, which is 8.3 ounces. If such a head is ⅔ of the weight of the club, which it ordinarily is, then the driver or wood weighs approximately 10.5 ounces to 12.4 ounces. Woods, including drivers, and irons, of substantially heavier weight than those discussed above, will interfere with a proper swing and are likely to cause injury to the player is swung with the force of ordinary play.

In the device of the invention, the golf club, shaft and head are so combined, or connected, in the preferred embodiment, as to be integrated into a single, structural unit, with no connecting or intervening material whose modulus of elasticity is less than the shaft, which would otherwise act to reduce the "feel" and sound to the user.

BACKGROUND

A playing golf club should provide "feel" to the golfer. Feel and sound are both generated at ball impact. In the irons, and particularly in the putter, the "feel" should be more intense so as to provide increased precision in controlling the ball. That is, the putter should provide a feeling of precision in controlling the ball. This invention discloses that high frequencies should not be felt even though some golfers may desire to hear high frequencies. As to "feel", high frequencies should be damped, or diffused, and not felt. This invention also discloses that the mid-range frequencies should be diffused or suppressed enough so as not to be felt and, thus, confuse the golfer.

Each golf club has a "sweet spot" on the face of the head. The "sweet spot" is the point on the face of the head, in which the golf ball is best struck and which moves the ball in a straight direction. The "sweet spot" is located on the face of the head on a line passing through the center of inertia of the head. When a ball is struck at the "sweet spot", there is a solid "feel" to the strike and little or no torque is imparted to the club. Presently, golfers test for the "sweet spot" on a putter by holding the face of the putter horizontally and dropping the ball on the face. They then listen for a "chunk", or low frequency, sound rather than a "ring", or high frequency sound. The "chunk" sound denotes the "sweet spot". The "sweet spot" are is a general area around the "sweet spot" which, if the golfer hits within the "sweet spot" area, provides an acceptable golf shot. The "sweet spot area" may be approximately 2.5" in length, on, say, a face which is approximately 4 inches long. The best part of the "sweet spot" area, to hit the ball, is approximately one third the diameter of a golf ball in width, or 0.56", although striking within a distance of 0.8" around the "sweet spot", will likely be quite an acceptable hit.

In one embodiment of this invention which enhances the high frequency sound in the head of the golf club, the golfer will hear a "ring" when he drops the ball on the "sweet spot" of the club.

In putting, it is intended that the ball be struck on the "sweet spot" on the face of the putter, which is generally at or near the central area of the face. It is common for golfers to strike the ball within the "sweet spot" area, however, it is also common to strike outside the "sweet spot" area, which is a bad strike.

SUMMARY OF THE INVENTION

This invention comprises a golf club which provides a low-frequency "feel" to the golfer. High frequency vibrations or the mid-frequency vibrations generated when a golf ball is properly struck, if felt in the grip, tend to destroy the feeling and psychology of control. If the golfer feels only the low frequencies in a proper strike, it gives a solid "feel" to the golf club and it gives the golfer a reference, to be sought in subsequent strikes or strokes. Therefore, in the golf club of the invention, and this is especially true in the case of the putter, only the low frequency vibrations will be felt in the hands of the golfer, but not the high frequency or mid-frequency vibrations. This is due in some cases to high frequencies and mid-frequencies being dissipated, or suppressed, but, in other cases, the high frequencies and mid-frequency may be somewhat present, but overwhelmed and masked by the intensity of the low frequency vibrations.

Many golfers also prefer to hear a low frequency sound in addition to the low frequency feeling of the grip. On the other hand, other golfers prefer to hear a high frequency sound an, for them, hearing a high frequency sound, when the ball is struck correctly, enhances their control. Still others have best control when they hear both high and low frequencies when the ball is struck correctly. Still others have best control if they hear no sound when the ball is struck correctly. The device of the invention diffuses or suppresses the mid=frequency vibrations, whether of sound or "feel".

A low frequency "feel" golf club and the various embodiments of low-frequency sound, high frequency sound and no sound, are taught herein. This is achieved through the use of a particular grip, described hereafter, which has a high modulus of elasticity.

A golf club having such grip transmits the low frequencies to the golfer and provides an extraordinary "feel" which the golfer will come to expect and anticipate after having used the club for a time. That is, a correct strike will cause a "feel" to the golfer which he comes to recognize and will seek to repeat. Thus, the golfer's game is improved. Such effects are even more noticeable in the putter, iron and utility club embodiments of the invention.

The preferred embodiment of the invention is a putter having a metal grip.

The golf club may be made of a single, unitary construction throughout or it may be assembled. Plating the golf club, after assembly, gives it a desirable, unitary construction. Such a golf club allows lower frequencies to be transmitted to the user so that he feels a "solid" touch and does not "feel" the mid-frequencies or the high frequencies which are somewhat like a "tickle". In this regard, high frequencies are defined as those above approximately 4000 Hz, mid-frequencies are defined as those between 1200 Hz and 4000 Hz and low frequencies are defined as those below 1200 Hz and below, to approximately 20 Hz. Frequencies as low as approximately 20 Hz and below, although not heard, are often asserted to be sensed by a person.

Plugging the shaft at both ends and having a sound chamber in the head or the grip, or both, as taught herein, enhance the low frequency "feel" and sound of the club. Utilizing no flexible or resilient materials to connect the grip to the shaft maintains and enhances the low frequency "feel". Connecting the shaft to the head in the same way maintains and provides further enhancement of low frequency "feel". Especially in the putter, this low frequency "feel" provides much better control of the strike. The desired low frequency "feel", in a golf club, is enhanced by the construction of the body of the grip having a high modulus of elasticity and by connecting the grip to the shaft without any intervening material having a low modulus of elasticity. In the putter, for best results, the shaft should have a high modulus of elasticity closely-related to that of the grip. A constant diameter shaft is, therefore, preferred over a tapered shaft, although a stiff, tapered shaft or a stiff, fluted shaft may be used.

Modulus of elasticity is a measure of the stiffness of a material.

In the woods and playing utility clubs, there may be more flexibility in the shaft. However, a great deal of the desired low frequency "feel" and low frequency sound, if low frequency sound is desired by the particular golfer, can be obtained by using the grip having a high modulus of elasticity, and using welding, brazing, boding, soldering, fusing, swaging, pinning or keying or similar connecting method to connect the grip to the shaft. The shaft may similarly be connected to the head. Such methods utilize no flexible or resilient material between the shaft and the grip or the shaft and the head and accomplishes the desired purpose of enhancing the desired low frequency "feel" and sound. There are no soft, highly resilient or flexible, materials between the "sweet spot", where the ball is struck, and the golfer's hands. There is a path of high modulus of elasticity material all the way from the face through the grip. That is, there is at least a "channel", or path, that can carry the desired vibrations without dissipation. Thus, there are no discontinuities along a narrow or wide path, through any surrounding discontinuities which may exist, from the face to the grip, that mask, dampen or distort the strike of the ball. There may be some discontinuities or resilient areas or connections. But there must be at least one path that carries the desired vibrations or "feel" to the golfer. It is best if the entire club from "sweet spot" through the grip is entirely high modulus of elasticity. But less than best will also work with less advantageous effect.

Prior art grips are often constructed of leather or rubber composition over a layer of rubber or paper which is glued or taped to the shaft. In the prior art, the shaft is often glued with epoxy or other adhesive to the putter head. Practically all prior art golf clubs, including the putters, are constructed of from five to thirteen different materials. Consequently, the "feel" of the prior art golf club to the hands of the golfer is lessened considerably.

The preferred embodiment of the invention, the putter, is constructed from the golfer's hands, or gloves, to the "sweet spot", of a single material or materials having closely-related moduli of elasticity and as torque-free as possible. It is desired that the putter shaft be very stiff and have a low torque rating. In the preferred embodiment of the putter, the putter grip, shaft and head are constructed of the same or similar material. A better putter is provided if it is then formed into an integral, single structure by connection with no intervening material between shaft, grip and head, and then plated as one piece. In some cases, it may be desirable, also, to plate the interior of the putter.

The material for making a golf club, including the grip, may be a pure metal, such as, but not limited to, titanium, aluminum, steel, stainless steel, mangnesium, zinc, copper, beryllium copper, bronze and brass or it may be alloys, metal mixtures or metal compounds. Various other materials such as, but not limited to polymers, carbon, graphite, Kevlar, boron, and graphite boron may be used, provided they have sufficient stiffness, that is, high modulus of elasticity. Ceramics may also be used. A preferred, economical material is low carbon steel. The modulus of elasticity, for such steels is approximately 30,000,000 psi. Malleable cast iron is approximately 23,000,000 psi. Gray cast iron is approximately 15,000,000 psi. This range of modulus of elasticity is considered closely-related and would be suitable. The modulus of elasticity of wood, on the other hand, is 2,000,000 psi or below and, therefore, is not closely-related to that of the above metals. Golf shafts of suitable material, having moduli of elasticity substantially in excess of 2,000,000 psi are readily available in the commercial market.

In the preferred embodiment of the putter, the grip is of the same material as the shaft and the head, although the grip may be further treated for better "feel" and for better control by the hands, by etching, bead blasting, machining, splatter or other coating which does not involved a material which will act to "cushion" or change the "feel" to the golfer.

When the invention is used in a wood or playing utility club, the grip may be constructed of a material substantially different than the material used in the shaft or the head of the golf club. Nevertheless, the grip is constructed throughout of the material having a high modulus of elasticity. Such grip gives a solid "feel" that enables the golfer to more accurately repeat his strikes. In the irons, woods and playing utility clubs, the shaft will have a modulus of elasticity which is substantially less than that of the shaft in the putter. In the playing utility clubs, the shaft of a sand wedge may approach the stiffness of the shaft in the putter. In the woods, the head may be of wood, metal, graphite, a plastic, such as Kevlar, Cycolac, high molecular weight compounds, or other hard material or mixtures, alloys, metal mixtures or metal compounds. Wood heads commonly have inserts of other materials.

The grip, whether for putter, iron, wood or playing utility club is constructed throughout of any of the mentioned materials having a high modulus of elasticity such as found in the low carbon steels and gray cast iron or higher. Such material will also have a relatively high hardness. The Brinell hardness of annealed ingot iron, which would be suitable, is approximately 69. Low carbon, nickel, silicon steels and hardened stainless steels have Brinell harnesses which range approximately from 100 to 600, depending on how they are quenched or anneals. They are very suitable. It is desired that they be machinable. Such material is preferably one or more of the metals, alloys, metal mixtures and metal compounds, polymers and other materials enumerated above. Such a grip never needs replacement. There is no deterioration of a grip constructed of such hard material. Other grips which are comprised of leather, simulated leather, rubber, rubber-like compositions or various other resilient or cushioning compositions, will deteriorate and do not convey the desired "feel" and sound.

It is to be appreciated that some of the advantages obtained herein by a high modulus of elasticity grip can still be obtained even though a film or other soft, thin covering is placed over the grip or the entire club. It is intended to include such variations within the concept of this invention. Such grip, although it may be a soft, thin covering, is, nevertheless, "constructed substantially throughout of one or more materials having a modulus of elasticity substantially greater than 2,000,000 psi."

It is preferred that the shaft extend substantially through or along the grip, say, to at least within ⅜" of the end of the grip. In some embodiments, as discussed herein, the shaft extends the full length of the grip.

The face of the head of the preferred embodiment, the putter, is generally flat, and is usually rounded at the corners and edges.

The face of the head of the golf club may be designed with a compound surface to correct for hitting the ball too far toward the toe or too far toward the heel of the putter. Such correction includes both correction of direction and correction of distance. The open heel and closed toe correct for direction when a missed hit, or hit outside the "sweet spot", occurs.

Loft, or slant angle of the face of a golf iron, determines the lift given to the ball. In general, greater loft, or slant angle, from the vertical, gives more lift to the ball and increases its roll.

It is, therefore, an object of this invention to provide a golf club which has a grip having a high modulus of elasticity.

Another object of this invention is to provide a metal grip for a golf club.

It is another object of this invention to provide a golf club which has a grip having a high modulus of elasticity, with no intervening material having a low modulus of elasticity, connecting grip to shaft.

It is still another object of this invention to provide a putter which has a grip, shaft and head all having high modulus of elasticity and all connected with no intervening material having a modulus of elasticity substantially less than said grip, shaft and head.

Another object of this invention is to provide a putter whose grip, shaft and head are comprised of the same or similar materials having closely-related moduli of elasticity.

Still another object of this invention is to provide a golf club which provides a solid "feel" of the strike of the golfer' hands.

A still further object of this invention is to provide a golf club which provides a low frequency "feel" when a correct strike occurs.

Still a further object of this invention is to provide a golf club which generates a high frequency sound when a correct strike occurs.

Still another object of this invention is to provide a golf club which provides a low frequency sound when a correct strike occurs.

Another object of this invention is to provide a golf club which provides little or no sound when a correct strike occurs.

A further object of this invention is to provide a putter, having a shaft which is stiff, torque free and does not mask, dampen or distort the strike of the ball.

Another further object of this invention is to provide a method of manufacture of a golf club having a grip having a high modulus of elasticity.

Further objects and features of the invention will become apparent from the following drawings and description.

Figure 15:
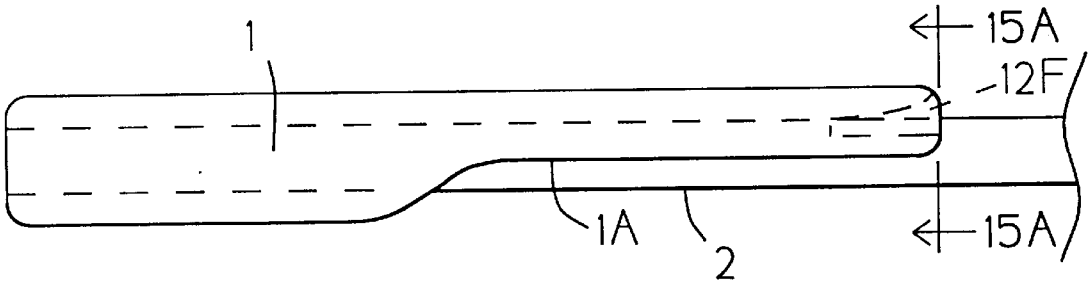
Figure 15A:
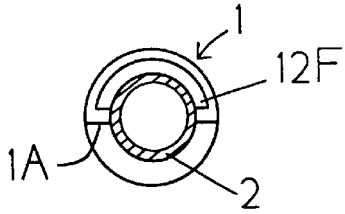
Figure 16:
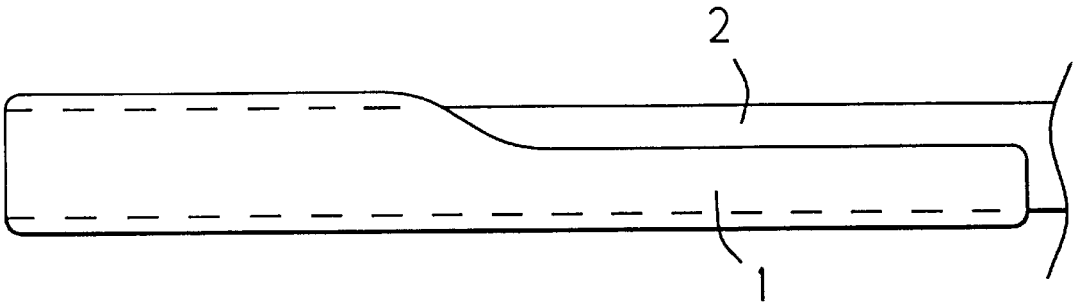
Figure 17:
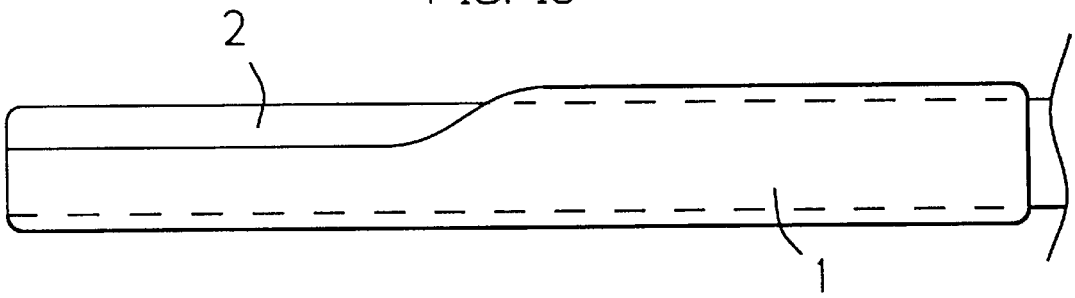
Figure 18:
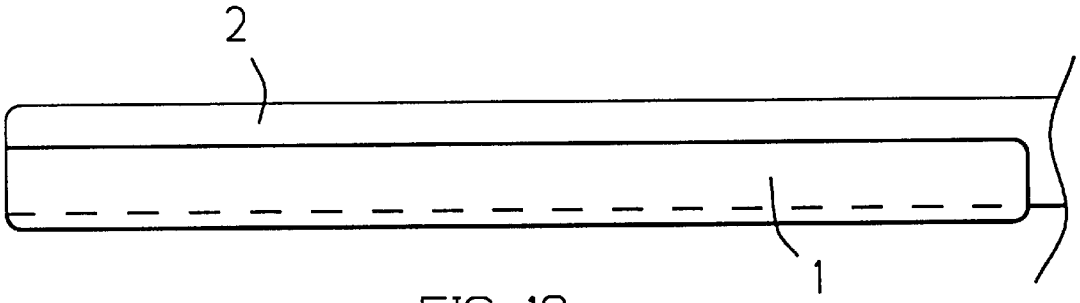
Figure 19:
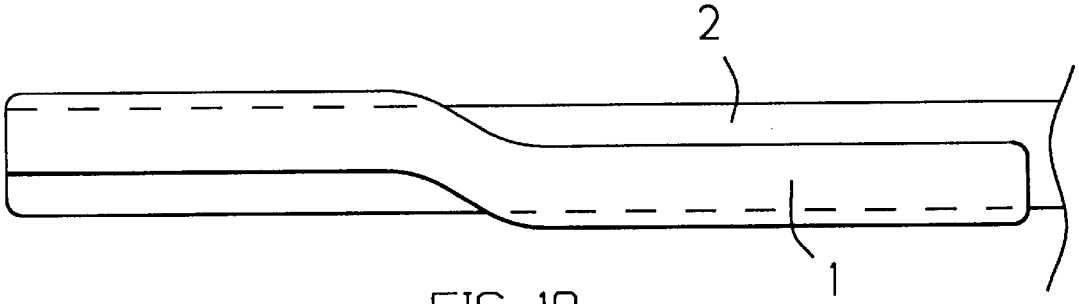
Figure 20:
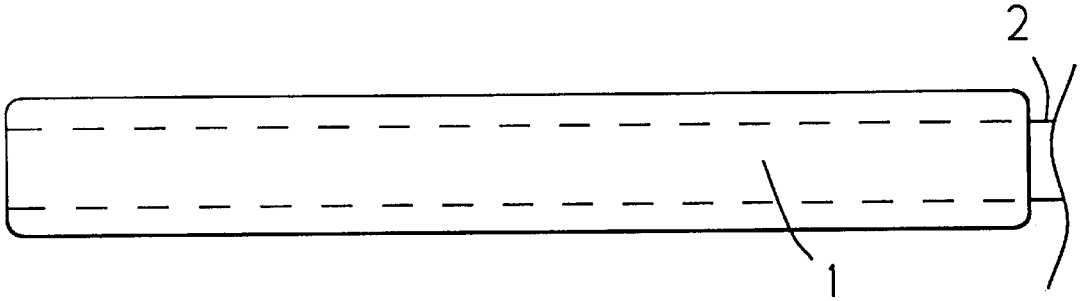

FIGS. 12 through 20, except FIG. 15A, illustrate the shapes of various grips of the golf club.

FIG. 15A is an end view of FIG. 15, with the shaft in cross-section, taken on line 15A—15A of FIG. 15, showing a resilient, semiconical insert.

Figure 21:
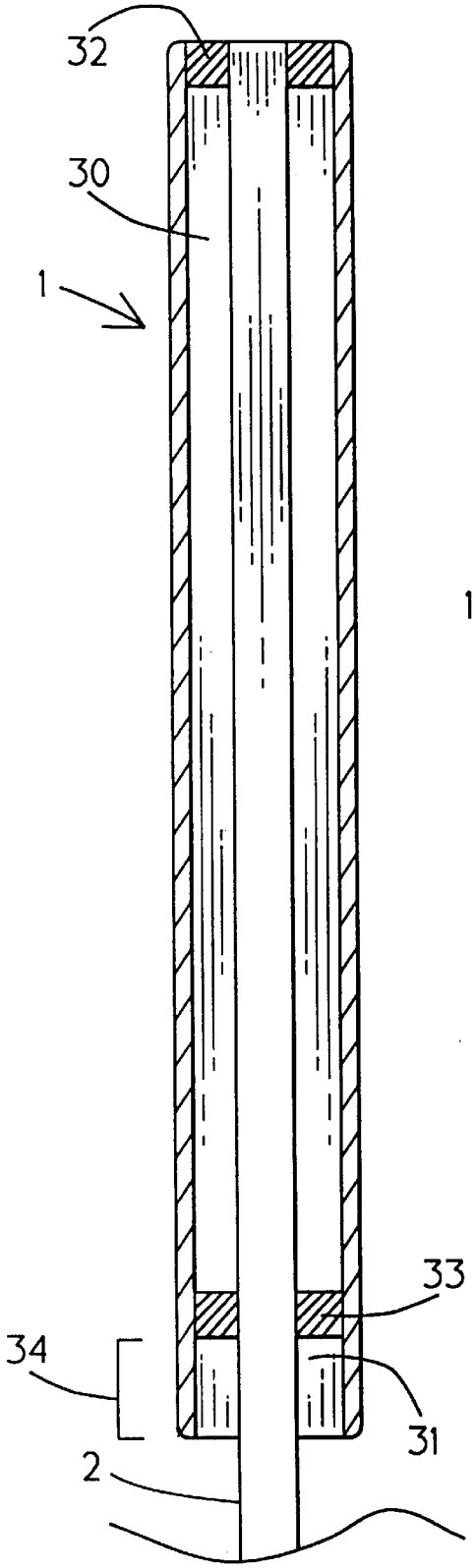

FIG. 21 is a partial cross-section of the body of a grip which maintains and enhances the low frequency vibrations which are felt and maintains and enhances the high frequency vibrations which are heard.

Figure 22:
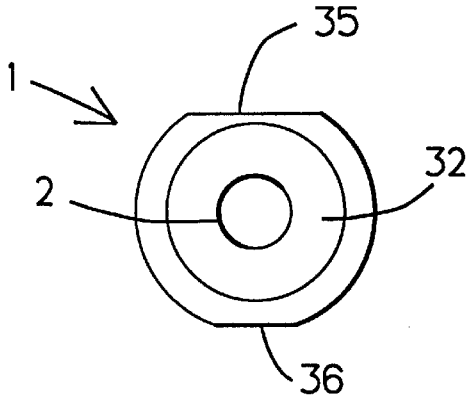

FIG. 22 is a top view of the grip of FIG. 21.

Figure 23:
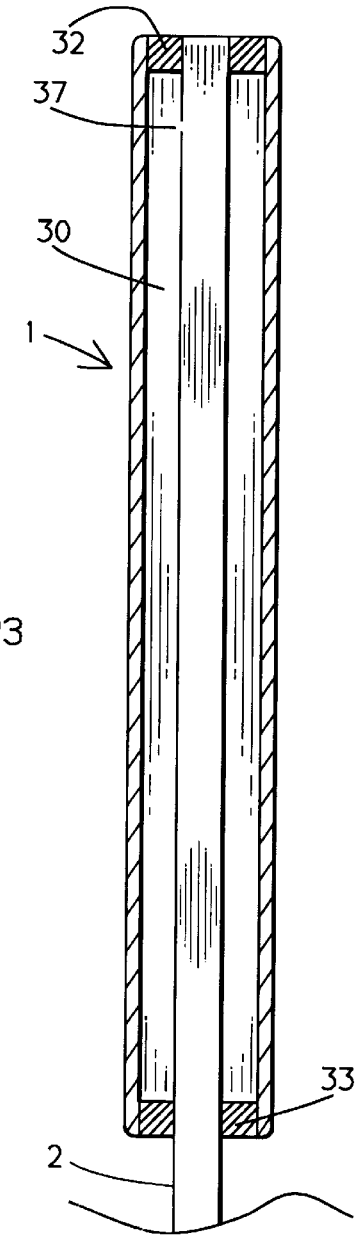

FIG. 23 is a partial cross-section of the body of a grip having a single chamber.

Figure 24:
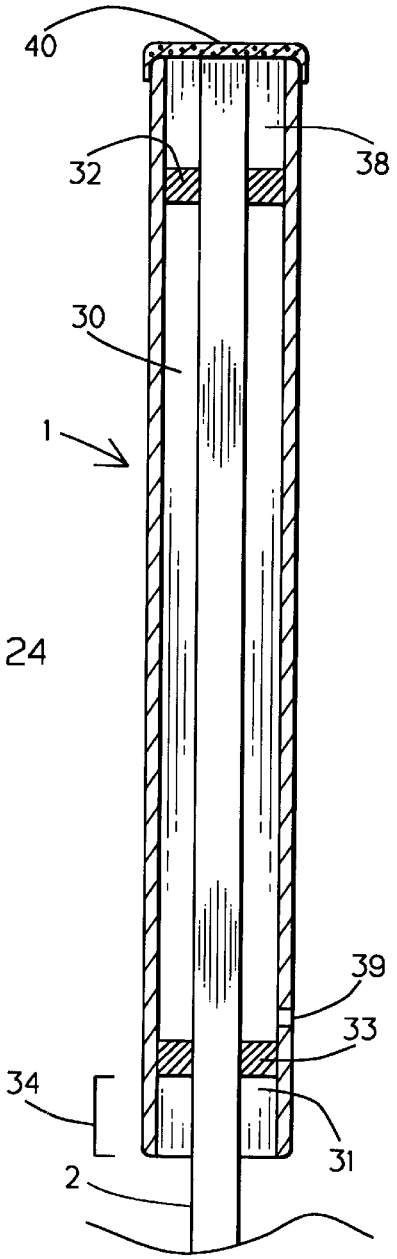

FIG. 24 is a partial cross-section of the body of a grip having an open chamber at the top and the bottom of the grip.

DESCRIPTION

Figure 1:
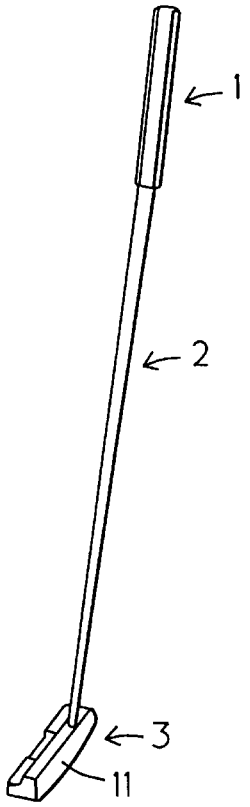
FIG. 1 is a golf club, a putter, showing grip, shaft and head.

In FIG. 1 is shown a golf club, a putter, comprised of a grip 1, a shaft 2 and head 3. The golf club may be welded, cast or forged or otherwise manufactured. Casting will be found to be difficult. Forging is a reasonable alternative, but individual manufacture of grip, shaft and head is much preferred. All of the parts of the putter are preferably made of the same high modulus of elasticity material, which may be pure, alloy or other mixtures or compounds. In the irons, woods and utility clubs, the grip has a high modulus of elasticity, but the shaft will have substantially more flexibility, or "whippiness" than does the shaft of the putter. The heads of the irons, woods and playing utility clubs may be of a different material than the grip, but are, preferably, also, of high modulus of elasticity. In the putter, it is desired to have the shaft measure a stiffness of approximately 7.0 or greater on the Fuji Kura golf shaft frequency analyzer. The entire putter has such stiffness or greater. Stiffnesses to approximately 9.0 have been obtained. This stiffness of 7 and higher is substantially stiffer than prior putters which usually measure below 6.

The golf club may be manufactured as a single piece, for example, but not limited to, casting, forging or stamping shaft and grip, shaft and head or grip, shaft and head. The preferred method of manufacture is manufacture of grip, shaft and head individually, which are then welded, clamped, brazed, bonded, interference fitted, soldered, fused, swaged, sweated, pinned, keyed or otherwise directly connected to each other with no soft material between them such as glue, epoxy, silicon or similar low modulus of elasticity material. Combinations of such methods may be used. If the parts are interference fitted, sometimes termed friction fit or force fit, the parts are manufactured to close dimensions and tolerances and forced together. If the parts are pinned, a hole is drilled through the shaft and through the head or in the grip, as the case may be. A pin, having an interference fit to the drilled hole, is then driven through the head or grip and through the shaft. After peening the pin in place, the pin is ground and polished to the surface of the golf club so as to provide a smooth surface in which the pin is hard to detect. In keying the parts together, keyways in both parts, shaft and grip or shaft and head, are provided and one or more keys are inserted to hold the two parts firmly together. Clamping, or compressing, particularly of the grip to the shaft, has also been found suitable. Care must be taken not to disfigure or distort the shape of the shaft, otherwise its structural integrity will not be retained.

Connections between grip and shaft or shaft and head, using epoxy, glue or similar intervening, adhering materials are not considered to be suitable, unless such materials contain a strengthening or hard filler as discussed hereafter. Such adhering materials, if not strengthened or hardened considerably, are flexible, highly resilient and "deaden" the "feel" and sound. Whatever form of direct connection or bonding is used, one must be careful not to distort the structural shape of the shaft. An interference fit of the shaft to the head, may be completed or strengthened by a plug driven into the shaft form the bottom of the head, after the shaft is inserted in the head. The same is true of the fit to the grip, wherein a plug may be inserted into the shaft through the top of a grip, to complete or strengthen the interference fit of the shaft to the grip. This, in effect, is a form of swaging which is, of course, a suitable direct connection method.

In the putter, a stiff, True Temper, tapered, shaft of low carbon steel having an outer diameter of 0.390"±0.020" at the tip and 0.580" to 0.680" at the butt, or grip, end, have been found suitable for connection to the grip and the head. Such shafts may be obtained from True Temper sports Division, 871 Ridgeway Loop Road, Suite 201, Memphis, Tenn. 38120-4066. There is a wide range of sources for golf shafts. These sources are known to those skilled in the art of making golf clubs. A parallel shaft of approximately 0.390" works very well, but is not quite as stiff as those mentioned above, which taper to a large grip end, of say, 0.680".

The preferred embodiment of the invention comprises a "unitary" golf club that has no "discontinuities" from the head through the shaft to the grip, to the golfer's hands, which "discontinuities" would otherwise cause "deadening" of the "feel" and sound, dissimilar vibration or frequency transition points. In a preferred embodiment, there is an unbroken continuity of metal from the "sweet spot" are of the head through the grip. In this way, the "strike" of the ball is not damped or distorted and a sensitive, solid "feel" is achieved. It has been found that closing the ends of the shaft, with plugs, provides a lot more feeling in the hands and reduces the high frequencies and harmonics. Also, it enhances the low frequency sounds.

Various coatings or surface treatment of the grip, the shaft or the head may be applied, such as, but not limited to, chrome, anodize, hardening, knurling, bead blasting, groove-cutting, sanding, etching or other coating or surface treatment which does not interfere with the structural integrity of the golf club. In the putter, the thickness of such coating or surface treatment should be maintained small enough so as not to interfere with either the "feel" or the stiffness of the putter.

Plating the entire club provides a better "feel" and helps to remove high frequencies and mid-range frequencies which are not desired to be felt. Chrome, nickel, cadmium, zinc or other non-corrosive platings are suitable. It is, of course, possible, to achieve some advantageous results by plating only the shaft and grip or the shaft and head or the grip and head. It has been previously proposed to plate the shaft.

The shaft of the putter, when made of a low carbon steel, is preferably about 0.4" outer diameter at its lower end, where it is connected to the head. In one embodiment, the hole in the head, which receives the shaft, is manufactured by drilling the hole to 0.369" and reaming it to 0.371". A shaft of 0.370 is then inserted. Dimensions of many shafts at their lower ends are likely to be within 0.02" of those just mentioned. The shaft outer diameter may increase to approximately 0.6" at the grip end. I prefer to manufacture putters which have parallel or nearly parallel shafts. In the putter, the shaft may, in some embodiments, suitably be held by interference fit. However in the irons and woods, additional strength is needed, therefore, the shaft should also be pinned to the head or hosel or strengthened by other means. A cross-pin running through the hosel and shaft, from the front side toward the green when playing, to the back side away from the green is usually used. Wrapping of the hosel and a short portion of the shaft with a 60 to 80 pound fishing line, Nylon line or other strong, tough line, is another means for strengthening the shaft-to-head connection in the irons and woods.

The shaft wall thickness is approximately 0.03". Shaft wall thicknesses vary from 0.030" to 0.060". Of course, it is to be realized that differing materials may have greater or less outer diameter and wall thickness because of the strength and modulus of elasticity of the particular material or materials used. The desired stiff "feel" of the putter requires a greater outer diameter, greater wall thickness or both, if the modulus of elasticity of the shaft material is less. The desired stiff "feel" requires less outer diameter and wall thickness, if the modulus of elasticity of the shaft material is greater.

Fluted shafts, or shafts having fluted portions may be used in the putter, inasmuch as the fluted portions are 10–15% stronger than unfluted portions. Therefore, fluted shafts may be somewhat smaller than unfluted shafts in outer diameter and wall thickness. Malleable cast iron, annealed ingot iron, and commercial wrought iron may be used because they have a modulus of elasticity fairly close to that of low carbon steels. Alloy steels, including nickel steel, chrome-nickel, chrome-vanadium, molybdenum and others, may be used in the putter inasmuch as their modulus of elasticity is approximately the same or greater than that of the low carbon steels. The strength and stiffness of such alloy steels and other alloys are often determined by their heat treatment rather than their composition.

The golf club preferably has a balance point within approximately 3 inches of midway between the top and bottom ends of the club. This is achieved mostly by increasing or decreasing the grip size and length. This helps to provide a solid feeling when striking the ball. In the putter, the shaft may be, for example, 35" long and the balance point would be approximately 17.5" from either end.

Figure 2:
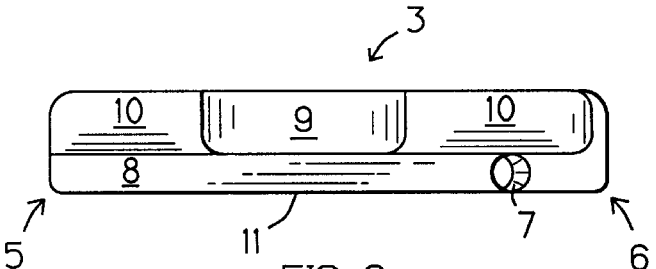
FIG. 2 is a top view of a putter head, showing the hole in the head to receive the putter shaft.

FIG. 2 is a top view of the head 3 of the preferred embodiment, the putter. It has no hosel, rather, the shaft is connected to the head 3 by insertion through hole 7, shown extending entirely through the head 3. Hole 7 need not extend all the way through head 3, but it does in the preferred embodiment. When it extends through the head entirely, a wooden plug may be inserted in the shaft, from the bottom of the club. A screw may be screwed into the wooden plug to tighten the shaft against the head.

Putter heads of the invention are approximately 3.75" to 5.25" in length. The head 3 illustrated is approximately 4.8" in length and approximately 0.9" high and 0.8" deep. FIG. 2 shows shaft hole 7 in the top surface 8 of the head 3. The top surface 8 may be approximately 0.4" wide. If, then, the hole for the shaft is 0.37", there is approximately a 0.015" wall on each side of the hole 7, if it is centered in the top surface 8. Other constructions are possible, but those dimensions are preferred. For example, hole 7 may be as wide or wider than top surface 8. Hole 7 may be located a bit to the rear of top surface 8 and, thus, not centered in top surface 8. This allows the user to see the entire face of the putter and adds minor offset without bending the shaft. That is not as aesthetically pleasing but, nevertheless, is very suitable functionally. The hole should not extend into the front face 11 of the putter head 3. Sound chamber, or cavity, 9 is disposed in valley 10 of the head. Cavity 9 provides a sound chamber which adds to the "feel" and sound of the putter.

Figure 2A:
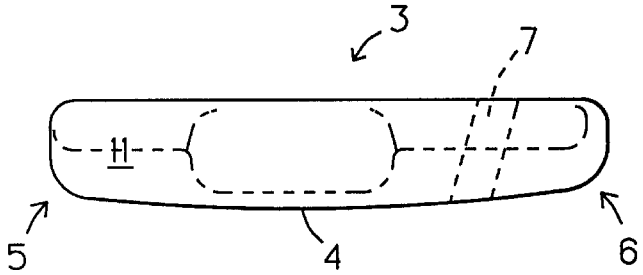
FIG. 2A is a front view of a putter head, showing the striking face.

FIG. 2A is a view of the striking face 11 of the putter head 3. The striking face 11 may also be seen in FIG. 1. In the preferred embodiment, as shown in FIG. 2A, the face 11 is flat with slightly rounded corners and edges as shown. The face 11 has a loft, or backward slant, of approximately 2 degrees to 4 degrees, depending on the golfer's preference. The toe 5 and heel 6 are rounded. The foot 4, where the putter head meets the grass, is rounded to approximately ¼" radius to prevent the head from "sticking" or digging into the grass or ground. The foot 4 is an arc from toe 5 to heel 6 having approximately a 20" radius.

Figure 2B:
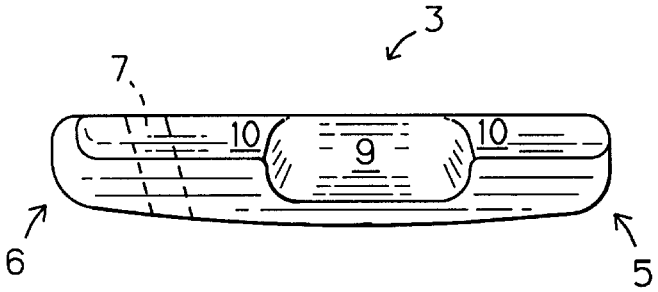
FIG. 2B is a rear view of a putter head.

FIG. 2B is a rear view of the head of the putter, showing valley 10 and sound chamber, or cavity, 9.

Figure 3:
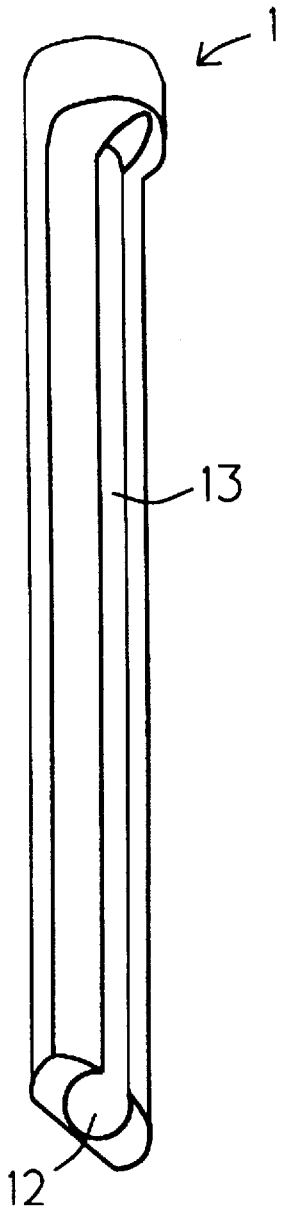
FIG. 3 is a perspective of one embodiment of the grip.
Figure 4:
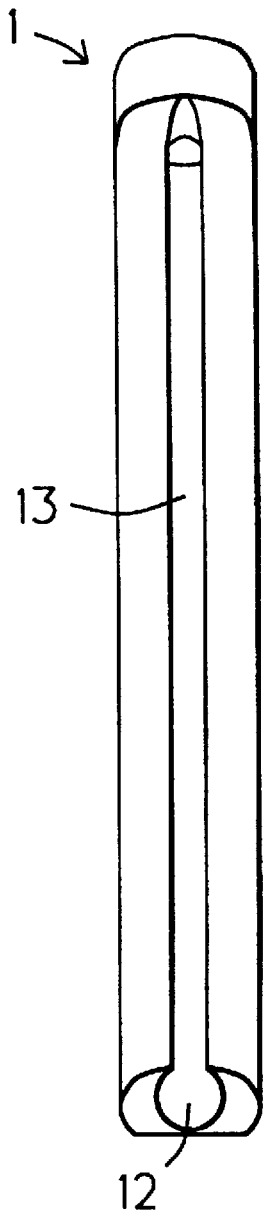
FIG. 4 is a rear view of the grip of FIG. 3.

FIGS. 3 and 4 illustrate one embodiment of the grip 1 which fits over the end of the golf club shaft 2. The grip 1 may have a flat front face, not shown, but is generally of an oval or, sometimes, circular, shape to fit well into the hands of the golfer. The entrance 12A receives the shaft, which extends to the end, or near the end, of the grip 1. Slot, or channel, 13 permits a direct "feel" of the putter shaft, adding to the sensitivity.

Figure 5:
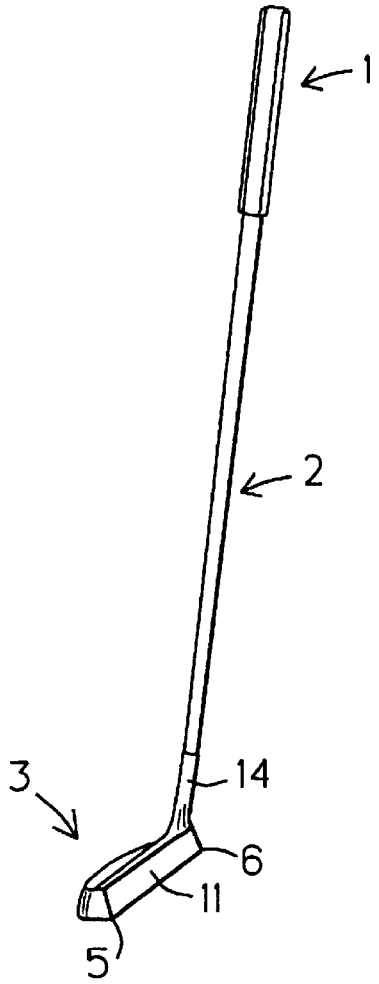
FIG. 5 is a putter, showing grip, shaft and a head having a hosel into which the shaft fits.

FIG. 5 is a putter in which the head 3 has a hosel 14 into which the shaft 2 is inserted. The hosel 14, whether in a putter or other golf club, may take various shapes as presently known in the art, to place the shaft forward toward the toe 5 of the head 3 or backward toward the heel 6 of the head 3, or toward the front of face 11 or toward the rear of the face 11 of the head 3.

Figure 6:
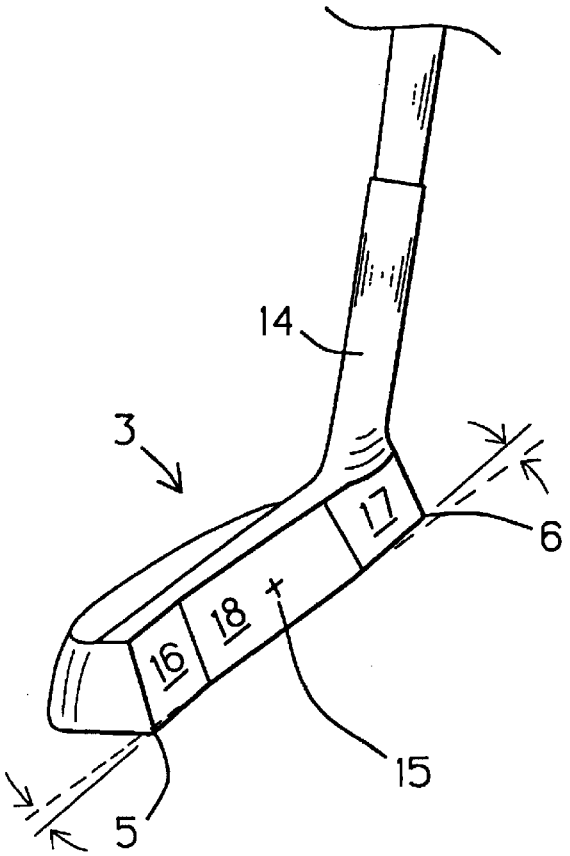
FIG. 6 is a putter, illustrating the "sweet spot", a closed toe and an open heel.

FIG. 6 shows a putter head 3, illustrating the "sweet spot" 15. The "sweet spot" area is approximately 2.6" in length which is approximately one and one half times the diameter of the golf ball. In the embodiment shown, the face 11 is a compound surface to compensate for hits outside the "sweet spot" area, toward the toe 5 or toward the heel 6.

A hit that is too far toward the toe of most putters will tend to slice, left to right. Also, the hit will go shorter than intended. To compensate for this, the putter has a closed toe area 16 with a greater loft. Similarly, a hit that is too far toward the heel will tend to hook right to left and go farther than intended. To compensate for this, the putter has an open heel 17 with a lesser loft. The toe area 16 is closed approximately 1.5 degrees and the heel area is open 1.5 degrees. The closed toe area 16 is approximately 0.8" in length, as is the length of the open heel area. In one embodiment, a precise measurement of 0.740"±0.005" was used as the lengths of each of the closed toe and open heel areas.

In the preferred embodiment of the invention, a putter, the face is flat and has a uniform loft, as illustrated in FIGS. 1, 2, 2A and 5.

Figure 7:
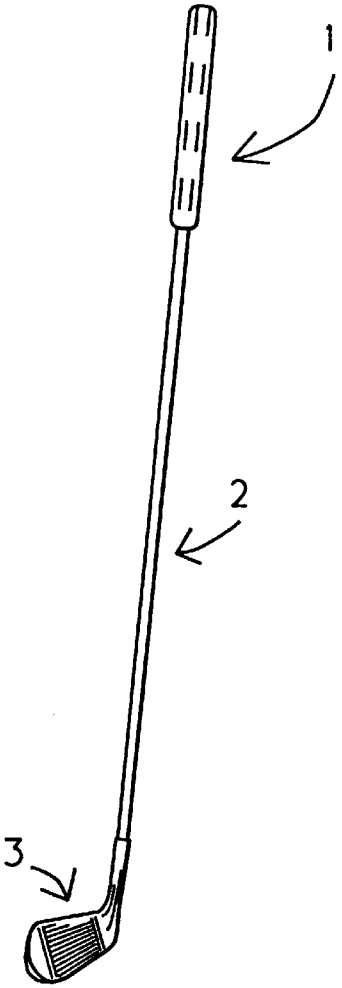
FIG. 7 is a golf club, an iron, having a grip constructed of material having high modulus of elasticity.

FIG. 7 is a golf club, an iron, having a grip constructed throughout of material having high modulus of elasticity, substantially in excess of 2,000,000 psi. The shaft 2 is connected to the hosel 14 of the head 3, by being welded, clamped, brazed, bonded, interference fitted, soldered, fused, swaged, sweated, pinned, keyed or otherwise directly connected to each other, as previously mentioned, without the use of any "deadening" material such as epoxy, glue or other adhering material disposed between the shaft and head. Again, combinations of such direct connection methods may be used.

It has been found that a hosel is not necessary in the golf club. The shaft may be advantageously inserted into or through a hold in the head of the club.

Figure 8B:
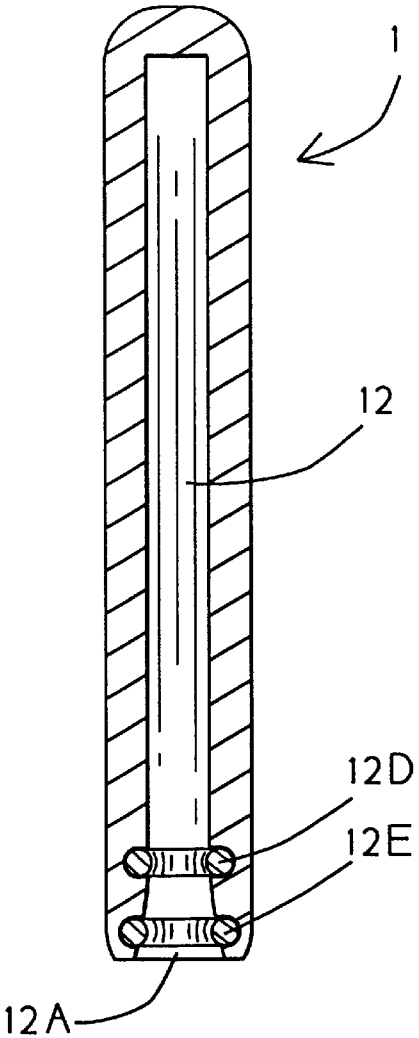
FIG. 8B is a grip having a cushioned entrance into the channel for accepting a flexible shaft. The cushioned entrance uses "O" rings.
Figure 8A:
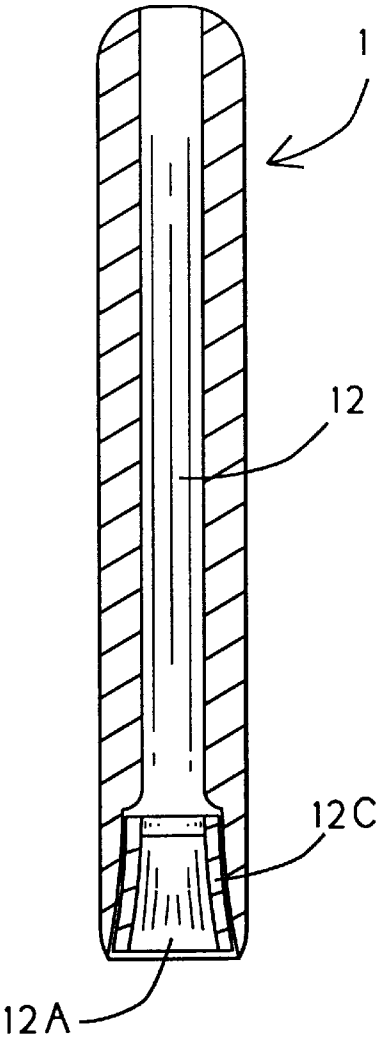
FIG. 8A is a grip having a cushioned entrance into the channel for accepting a flexible shaft.
Figure 8:
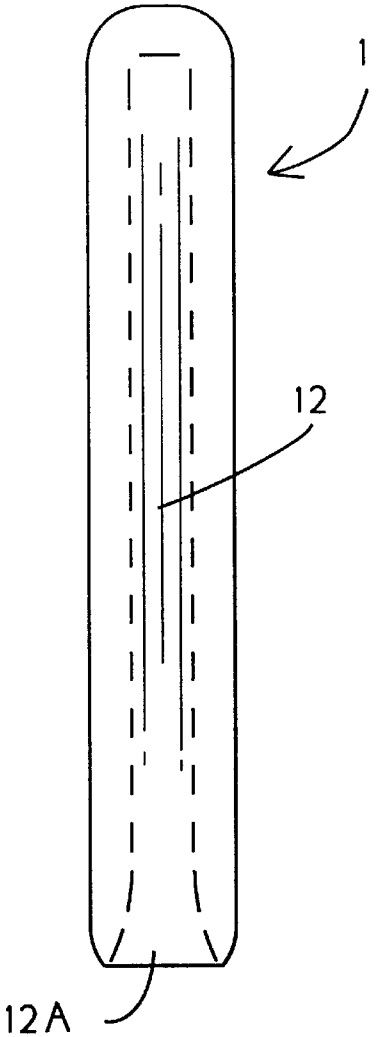
FIG. 8 is a grip having a tapered entrance into the channel for accepting a flexible shaft.

FIG. 8 is a grip 1 having a tapered entrance 12A into the channel 12 which receives the golf club shaft. Such tapered entrance may be used on the grip of a putter, iron, wood and playing utility club, but is most useful in the wood golf club because of the high flexibility required of the shaft. An entrance which is not tapered but has sharp edges, in a driver, for example, will interfere with the flexibility of the shaft and is likely to cause undue stress and breakage of the shaft at or near the grip 1. The more flexibility in the shaft, the longer and wider should be the taper of tapered entrance 12A.

FIG. 8A is a grip 1 having a cushioned entrance 12A into the channel 12 for accepting the shaft. This embodiment is particularly adapted for use in a wood, particularly the driver, in order to allow the shaft to flex sufficiently without causing undue stress at or near the grip. It is noted that the channel 12 extends entirely through the grip 1. In cushioned entrance 12A is a truncated cone 12C of rubber or similar flexible, resilient material which cushions the "whip" of the shaft in the wood embodiments of the invention. The resilient material of cone 12*c* is disposed to cushion the flexing of the shaft 2 against said tapered entrance of said grip 1. Any other suitable, resilient material may be used such as, but not limited to, Delrin, Nylon, polypropylene, and various other polymers, plastics, and high molecular weight compounds.

FIG. 8B is a grip 1 having a cushioned entrance 12A into the channel 12, for accepting the shaft. The cushioned entrance has two "O" rings 12D and 12E disposed therein. This embodiment, like the embodiment of FIG. 8, is particularly adapted for use in the driver or in other woods. There may be a single "O" ring or more than two "O" rings depending on how much cushioning is desired for the shaft 2 of the driver or the wood. The "O" rings may be of the same diameter as each other or the outer "O" ring may be slightly larger in diameter than the inner ring. Such "O" rings may be made of rubber or other suitable resilient material.

Notwithstanding the tapered entrance 12A, in FIGS. 8, 8A and 8B, it may be seen that shaft is still firmly connected to grip 1.

Figure 9:
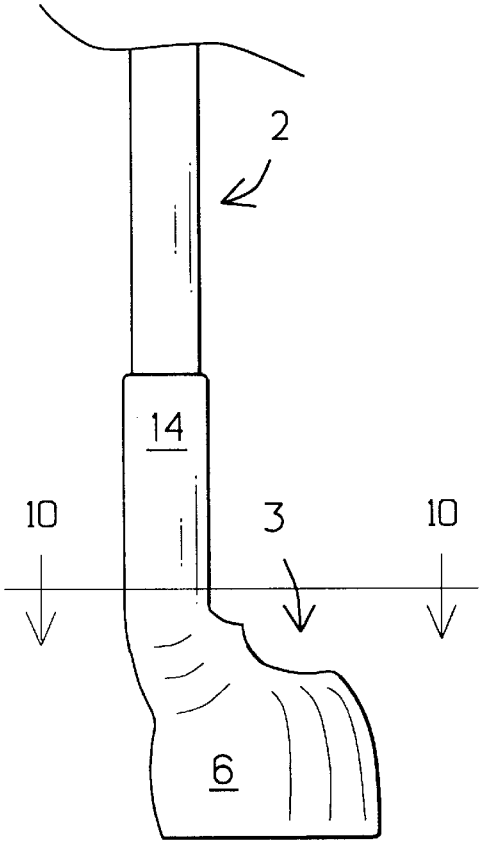
FIG. 9 is a view from the heel of a putter in which the head has a hosel into which the shaft fits.

FIG. 9 is a view of a putter head 3 from the heel 6. The embodiment shown has a hosel 14 which may be seen to place the shaft 2 ahead of, or at least forward with respect to the face of the head 3. Numerous hosel shapes are available, placing the shaft wherever desired. Further, it is to be appreciated, if the shaft enters a golf club head which has no hosel, as shown in FIG. 1, the putter shaft 2 itself may be curved at or near its entrance into the putter head 3 so as to place shaft 2 wherever it is desired and to direct the shaft 2 in whatever direction is desired. Often the shaft is curved so that throughout most of its length it allows the golfer to see the entire face of the putter and allows for some offset. In some embodiments, the shaft, throughout most of its length, points toward the "sweet spot" rather than toward the entrance of the shaft into the head. I prefer to curve the shaft so that it is behind the face and so that it does not point to the sweet spot.

Figure 10:
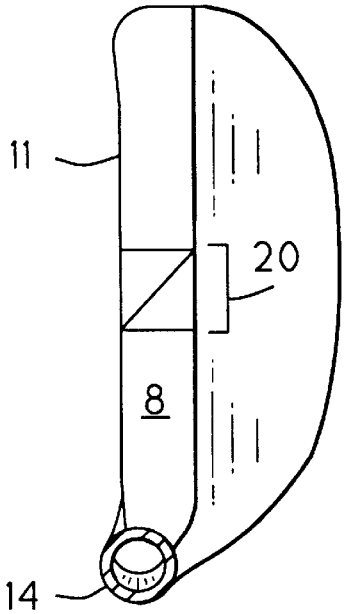
FIG. 10 is a putter head having a hosel and, also, having sight alignment markings, which assist in hitting the ball at an optimum area within the "sweet spot" area.

FIG. 10 is a top view taken on line 10—10 of FIG. 9, showing the hosel 14 and top surface 8. In this embodiment, there is a "Z" alignment marking 20 in the top surface 8. The "Z" is centered above the "sweet spot". A hit within plus or minus 0.4" (0.8" wide) of the "sweet spot" is a good hit.

In the golf club of the invention, if the ball is hit toward the heel or toward the toe, from the "sweet spot", a difference tone and different vibrational "feel" is generated, depending on how far from the "sweet spot" the hit is made. This helps the golfer to develop this form so as to habitually hit the ball on or near the "sweet spot".

Figure 11:
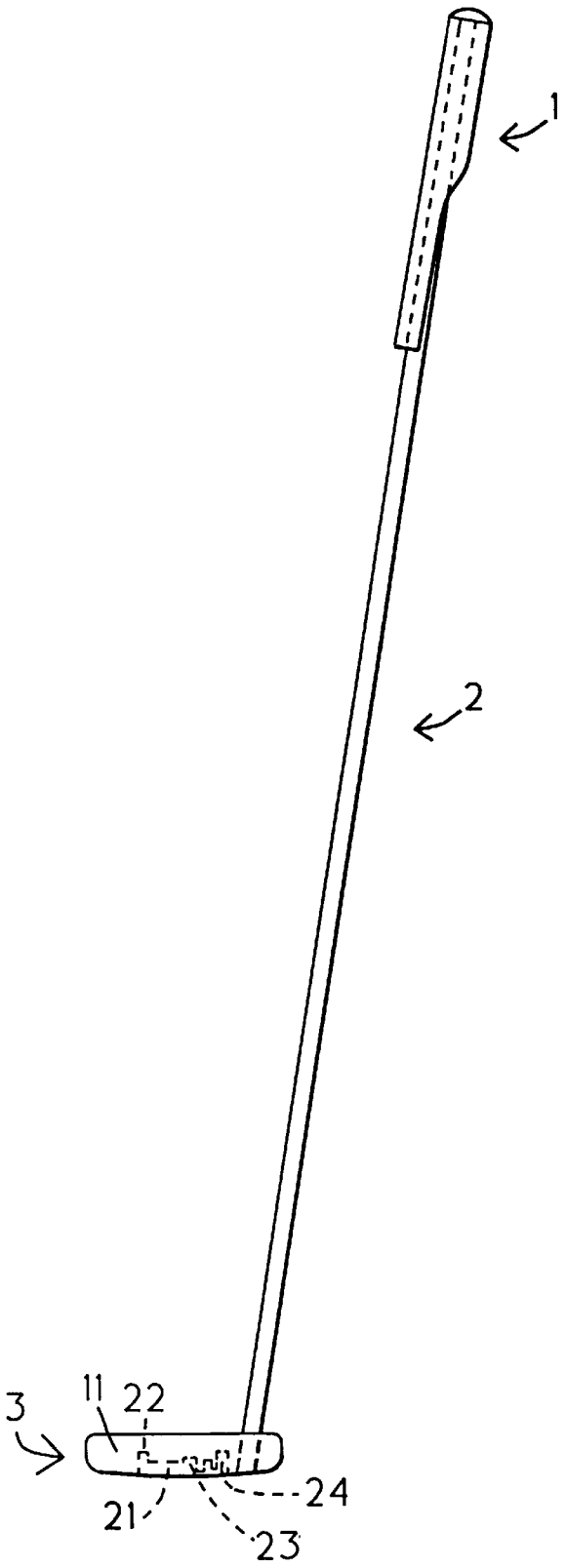
FIG. 11 is a putter, with head, shaft and grip drawn in scale to relative size, having a sound chamber with resonating elements, shown by hidden lines.

FIG. 11 is a putter of the invention, drawn to relative sizes, in which the grip is approximately 9" long and 1" in outer diameter. The shaft is approximately 35" long from end to end and approximately 0.375"±0.020" in outer diameter. The putter head is approximately 4.5" long. The putter head 3 has a sound chamber 21 having resonating elements, or bores, 22, 23, and 24 therein. Such bores may be circular or rectangular, as shown in more detail in said Golf Putter application of which this is a continuation-in-part. The shaft 2 may extend through head 3, as shown, or may terminate within head 3. In another embodiment, head 3 may have a hosel, into which shaft 3 extends. The hosel-free embodiment, which is shown, is preferred.

As previously noted, closing both ends of shaft 2 provides a sound chamber within the shaft which enhances the low frequency "feel" and sound.

While the putter head, shaft or grip may include materials of lower modulus of elasticity, such as lead, filling the bores 21, 22, 23 and 24, there is, preferably, no material with a modulus of elasticity substantially lower than malleable cast iron, in the structure or the connections between head, shaft and grip from the "sweet spot" through the grip.

A putter made in accordance with the invention, using sound chambers, such as by closing both ends of shaft 2, a cavity such as 9 shown in FIG. 2B, resonating elements or bores as shown in FIG. 11, or variations thereof, will provide the golfer an amplified, low frequency sound and "feel" when he hits the ball correctly. A bad hit will provide a high frequency "feel" and sound of 8000 cycles per minute and up. When the ball is hit within the "sweet spot area" of approximately 2.5" in length, the low frequency sound and "feel" originate in the unitary construction of the putter and are maintained and amplified by the resonating elements, sound chamber and the shaft with closed ends.

A great deal of such low frequency sound and "feel" is obtained in the putter, iron, wood and playing utility club, by the high modulus of elasticity grip and providing a direct connection which is a high modulus of elasticity connection to the shaft. The low frequency sound and "feel" is enhanced by such direct, high modulus of elasticity connection between the shaft and the head.

FIGS. 12 to 20, except for FIG. 15A, illustrate various shapes of grips which may be used in putters, irons, woods or playing utility clubs. The grip 1 and the shaft 2 may be connected to each other by any of the several means previously mentioned.

Figure 12:
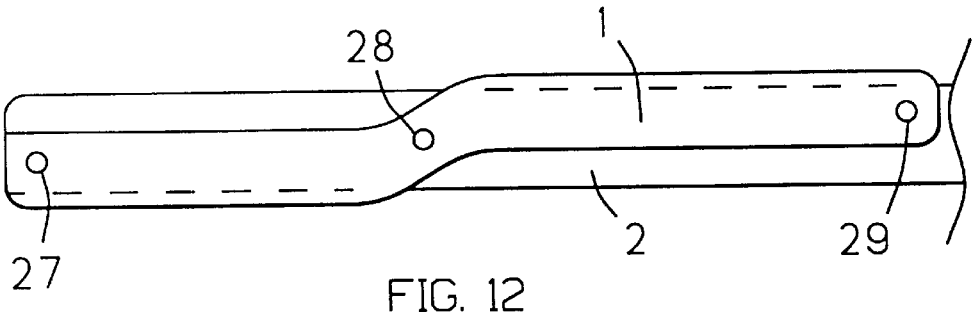
Figure 13:
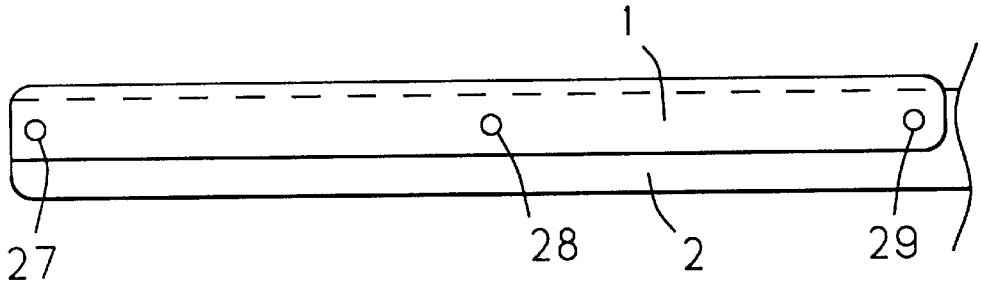
Figure 14:
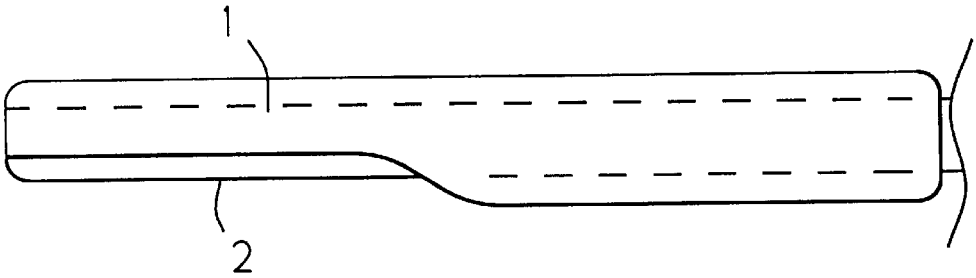

FIGS. 12 and 13 illustrate the use of pins 27, 28 and 29 to hold the grip 1 to the shaft 2. The pins, of course, are driven in and peened in place. They may then be ground flush with a grip and polished so as to be invisible. This is one of the preferred forms of connection because it is a firm, strong connection and there is no intervening material between the shaft and the grip.

Pins (not shown) may similarly be used to connect the shaft 2 to the putter head 3 shown in FIG. 1, or hosel 14, shown in FIG. 6.

The various shafts 2, in FIGS. 12 through 20, are shown as extending to the ends of the grip 1, the shaft 2, however, the shaft 2 may terminate short of the end of the grip 1.

In FIGS. 12 to 20, there is no intervening material between the shaft and the grip, except in FIGS. 15 and 15A are shown an insert, as described hereafter. If a connecting or bonding material is used, between shaft and grip or shaft and head, it preferably has a high modulus of elasticity substantially greater than that of epoxy, glue or other adhesive. In the preferred embodiment of the putter, the modulus of elasticity of any intervening material, if any, is not less than the modulus of elasticity of the grip. The high modulus of elasticity in connecting the shaft to the grip and shaft to the head, conveys the sound and the "feel" of the golf club to the golfer. In this invention, resilient adhesives and epoxys or other flexible or resilient materials are not used to connect the shaft and the grip or the shaft and the head, except for modified, suitable epoxy, adhesive or other intervening agent, because flexible or resilient adhesives and epoxys and the like reduce or modify the "feel" and sound of the golf club.

Modified, suitable adhesives, epoxy or other flexible or resilient material which are substantially hardened and strengthened by fillers or mixtures, such as a metal filler, may be used as intervening material provided the modulus of elasticity of such intervening material is approximately 100,000 psi or greater. This will still fairly carry a significant part of the sound and "feel" of the strike, to the hands and ears of the golfer.

The various grips of FIGS. 12 to 20, when used for irons, woods or playing utility clubs, may be adapted or modified, using the entrances shown in FIGS. 8, 8A and 8B. For example, it may readily be seen how FIGS. 14, 17 and 20 can be modified to incorporate the structures shown in FIGS. 8, 8A or 8B.

FIG. 15 illustrates how the concepts of FIGS. 8, 8A and 8B can be utilized in those instances wherein the grip 1 does not encircle the shaft 2. In FIG. 15 a tapered, semiconical, resilient insert 12F is shown, which cushions the shaft 2 when it flexes against grip 1, to prevent undue stress in shaft 2. Similar to FIG. 8, the entrance 12A to the grip channel 12 is tapered. A resilient insert 12F fits between shaft 2 and grip 1.

FIG. 15A is an end view, with the shaft 2 in cross-section, taken on line 15A—15A of FIG. 15, showing the resilient conical, semiconical insert 12F, adapting the grip to be used for irons and, particularly drivers and other woods. Such insert is preferably of rubber, but various other resilient materials may be used. Shaft 1 had a cavity for receiving the insert 12F, which prevents shaft 2 from having a high stress point where it emerges from grip 1. It is noted in FIG. 15A, that shaft 2 is in cross-section, insert 12F is viewed from its outer end, and edge 1A of grip 1 is visible in end view. It would be suitable to make insert 12F extend around shaft 2 to edge 1A, and to the corresponding edge on the other side of shaft 2, for ease of construction.

FIG. 21 is a partial cross-section of the body of the grip which maintains and enhances the low frequency vibrations which are felt and maintains and enhances the high frequency vibrations which are head. The high frequency sound vibrations are transmitted to the hearing of the golfer. Theoretically, it is believed that the club dissipates and reduces the mid-range and high frequencies so that they are not transmitted to the golfer's hands. The shaft 2, which is not shown in cross-section, extends within the grip 1, shown in cross-section, and forms two sound chambers 30 and 31. Collar 32 is located at the top of the grip 1 and extends around shaft 2, mounting it firmly in place within grip 1. Collar 32 is also metal or other high modulus of elasticity material inasmuch as it connects the shaft to the grip. Collar 32 is connected to grip 1 and shaft 2 by any of the means previously mentioned, by being welded, clamped, brazed, bonded, interference fitted, soldered, fused, swaged, sweated, pinned, keyed or otherwise directly connected to each other by methods which do not use resilient or flexible materials. Combinations of such direct connection methods may be used.

Collar 33 is constructed and fitted in the same manner as collar 32. Collar 33 is fitted toward the lower end of grip 1. Collar 33 also extends around shaft 2 mounting it firmly within grip 1.

The grip length ranges from approximately 8" to 10". The inner diameter of the grip, for example may be ¾" and may be, say 1" in outer diameter. Collars 32 and 33, may be, for example, ⅜" inner diameter and just under ¾" outer diameter in order to fit within grip 1. Collars 32 and 33 may be from ¼" to ½" thick or even thicker. Thinner collars bend somewhat when the shaft vibrates as the ball is hit and do not provide sufficient structural strength to properly connect the shaft to the grip. Such collars 32 and 33 provide a counterbalance to the golf club, to help place the balance point of the golf club approximately midway along the shaft as discussed previously. Collars 32 and 33 also help to diffuse high frequency vibrations from being felt in the golfer's hands. Chamber 30 maintains and enhances the low frequency vibrations which are felt in the golfer's hands. Also, chamber 30 is believed to reduce the mid-range and high frequency sound otherwise created upon striking the golf ball. Chamber 31, which is an open chamber, which may also be called a cavity, is a resonant chamber which provides high frequency sound. By adjusting the length 34 of the chamber 31, the high frequency tone can be adjusted to a desired pitch. Length 34 may vary from approximately 1/16" to 3" in order to produce a high frequency sound of the golfer's desired pitch. If collar 33 is placed farther than approximately 3" from the end of grip 1, it will cause the shaft 2 to undesirably "buzz" against grip 1, upon a hard strike, because of the substantial flexing of shaft 2.

It is to be appreciated that the grip 1 could be reversed with the chamber 31 on the upper end of grip 1, but that is not so effective and chamber 31 does not then provide the clear, high frequency sound provided when it is at the lower end of the grip 1.

Shaft 2 in FIG. 21 may be, for example, ⅜" outer diameter, or just less than that in order to fit within collars 32 and 33 and have a wall thickness of approximately 0.030" to 0.060".

FIG. 22 is a top view of the grip of FIG. 21. Shaft 2 is disposed within grip 1 and is surrounded by collar 32. A preferred shape of the grip 1 includes flat surface 35 and flat surface 36 which shape gives the golfer good control of the grip.

FIG. 23 is a partial cross-section of the body of a grip having a single chamber 30. Chamber 30 extends form one end of grip 1 to the other. That is, collar 32 and collar 33 are located at the ends of the grip 1, creating a single chamber 30. Air pressure relief hole 37 is disposed in shaft 2 to prevent chamber 30 from having any effect due to change in altitude causing change between air pressure inside and outside of chamber 30. FIG. 23 provides a lower frequency "feel" in the grip. High frequency sounds do not exist or are only weakly heard form such embodiment.

FIG. 24 is a partial cross-section of the body of grip 1 having an open chamber 38 at the top and open chamber 31 at the bottom of the grip 1. Collars 32 and 33 are each shown as being located a short distance from the ends of grip 1. Again, such collars 32 and 33 may be spaced from 1/16" to 3" from the ends of the grip. It is noted that an air pressure relief hole 39 is disposed in grip 1. Also, a cap 40, which may be of an open-pore, foam rubber, a screen or other porous material may or may not be utilized to cover the top chamber 38 and keep out the dirt. It is to be appreciated that shaft 2 may terminate at collar 32.

A golf grip constructed as set forth herein has been found to provide better sound and "feel" to the golfer. Connecting the grip to the shaft in the manner taught, adds to the sound and "feel". Connecting the shaft to the head, as taught herein, with no intervening material, further contributes to the better sound and "feel".

In the preferred embodiment of the invention, a putter, constructed as set forth herein has been found to provide a golfer with a low frequency "feel" having a vibrational intensity several times that of prior putters. This is particularly true in the case of a correct hit, that is, a hit within the "sweet spot" area. The low frequency sound generated is also twice or more as great as any of such prior putters. The tone generated may be adjusted from approximately 800 to 2300 cycles per minute by reducing the length of the sound chamber 30 or the length of the grip or both.

Although specific embodiments and certain arrangements have been illustrated and described herein, it will be clear to those skilled in the art that various modification and embodiments may be made incorporating the spirit and scope of the underlying inventive concepts and that the same are not limited to the particular examples herein shown and described except insofar as indicated by the scope of the appended claims.

I claim:

1. A playing golf club, other than a putter, said golf club comprising a grip comprised of a body, said playing golf club further comprising a shaft and a head, said head having a face for striking a golf ball, said shaft having opposite ends, said grip connected to one of said ends and said head connected to the other of said ends, and wherein said body of said grip is comprised of one or more materials having a modulus of elasticity substantially greater than 2,000,000 psi and wherein said shaft extends a substantial distance into said grip and wherein said shaft is fitted to the inner diameter of said high modulus of elasticity grip throughout said distance.

2. The playing golf club of claim 1, wherein said shaft extends into said grip substantially throughout the length of said grip.

3. The playing golf club of claim 1 wherein said grip has an open channel through which said shaft may be felt.

4. A playing golf club, other than a putter, said golf club comprising a grip comprised of a body, said playing golf club further comprising a shaft and a head, said head having a face for striking a golf ball, said shaft having opposite ends, said grip connected to one of said ends and said head connected to the other of said ends, and wherein said body of said grip is comprised of one or more materials having a modulus of elasticity substantially greater than 2,000,000 psi and wherein said shaft extends a substantial distance along the length of said grip and is connected to said grip substantially throughout said distance.

5. A playing golf club comprising a grip comprised of a body, said playing golf club further comprising a shaft and a head, said head having a face for striking a golf ball, said shaft having opposite ends, said grip connected to one of said ends and said head connected to the other of said ends, and wherein said body of said grip is comprised of one or more materials having a modulus of elasticity substantially greater than 2,000,000 psi and wherein said shaft extends a substantial distance into said grip and wherein said shaft is fitted to the inner diameter of said high modulus of elasticity grip throughout said distance and wherein said grip and said shaft are connected with no intervening material having a modulus of elasticity substantially less than 100,000 psi.

6. A playing golf club comprising a grip comprised of a body, said playing golf club further comprising a shaft and a head, said head having a face for striking a golf ball, said shaft having opposite ends, said grip connected to one of said ends and said head connected to the other of said ends, and wherein said body of said grip is comprised of one or more materials having a modulus of elasticity substantially greater than 2,000,000 psi and wherein said shaft extends a substantial distance into said grip wherein said grip has a tapered entrance to receive said shaft.

7. The golf club of claim 6 wherein a resilient material is included in said tapered entrance, and wherein said resilient material is disposed to cushion the flexing of said shaft against said tapered entrance of said grip.

8. The golf club of claim 7 wherein said resilient material comprises one or more "O" rings.

9. A playing golf club, other than a putter, said golf club comprising a grip having a body, a shaft and a head, said head having a face for striking a golf ball, said shaft having opposite ends, said grip connected to one of said ends and said head connected to the other of said ends, and wherein said body of said grip is constructed substantially throughout of one or more materials having a modulus of elasticity substantially greater than 2,000,000 psi and wherein said shaft extends a substantial distance within said grip and wherein said shaft is fitted to said grip substantially throughout said distance.

10. A playing golf club comprising a grip having a body, a shaft and a head, said head having a face for striking a golf ball, said shaft having opposite ends, said grip connected to one of said ends and said head connected to the other of said ends, and wherein said body of said grip is constructed substantially throughout of one or more materials having a modulus of elasticity substantially greater than 2,000,000 psi, and wherein said golf club is entirely plated.

11. A playing golf club, other than a putter, said golf club comprising a grip having a body, a shaft and a head, said head having a face for striking a golf ball, said shaft having opposite ends, said grip connected to one of said ends and said head connected to the other of said ends, and wherein said body of said grip is constructed substantially throughout of one or more materials having a modulus of elasticity substantially greater than 2,000,000 psi, and wherein said shaft is hollow and wherein is included sealing means at or near each end of said shaft and wherein said shaft extends into said grip a substantial distance and wherein said shaft is attached to said grip substantially throughout said distance.

12. A playing golf club comprising a grip having a body, a shaft and a head, said head having a face for striking a golf ball, said shaft having opposite ends, said grip connected to one of said ends and said head connected to the other of said ends, and wherein said body of said grip is constructed substantially throughout of one or more materials having a modulus of elasticity substantially greater than 2,000,000 psi, and wherein said grip has a slot therein through which the shaft can be felt by the golfer while hitting the ball.

* * * * *